US007217469B2

(12) United States Patent
Hobmeyr et al.

(10) Patent No.: US 7,217,469 B2
(45) Date of Patent: May 15, 2007

(54) FLUID HANDLING DEVICE FOR HYDROGEN-CONTAINING PROCESS FLUIDS

(75) Inventors: Ralph Hobmeyr, Mainz-Kastel (DE); Dirk Wexel, Mainz-Kastel (DE)

(73) Assignee: General Motors Corporation, Detroit, MI (US)

( * ) Notice: Subject to any disclaimer, the term of this patent is extended or adjusted under 35 U.S.C. 154(b) by 566 days.

(21) Appl. No.: 10/445,420

(22) Filed: May 27, 2003

(65) Prior Publication Data

US 2004/0241020 A1 Dec. 2, 2004

(51) Int. Cl.
*H01M 8/00* (2006.01)
*F01D 11/00* (2006.01)

(52) U.S. Cl. ..... 429/19; 415/111; 415/112; 417/423.11

(58) Field of Classification Search ..... None
See application file for complete search history.

(56) References Cited

U.S. PATENT DOCUMENTS 3,532,444 A * 10/1970 Rene ..... 417/423.11
4,924,817 A 5/1990 Seelen
5,855,469 A 1/1999 McConnell
6,224,060 B1 5/2001 Parker et al.

* cited by examiner

*Primary Examiner*—Jonathan Crepeau
(74) *Attorney, Agent, or Firm*—Harness, Dickey & Pierce, P.L.C.

(57) ABSTRACT

The present invention relates to a process fluid handling device in an electrochemical cell system having a fluid barrier between a process fluid compartment and a drive compartment of the fluid handling device. The fluid barrier comprises an interconnection compartment, filled with barrier gas. The pressure of the interconnection compartment is maintained above the process fluid and drive compartments, by fluid communication with barrier gas stored in a storage device. The barrier gas is preferably a non-reactive and dehumidified gas. The present invention also contemplates methods of isolating the hydrogen-containing process fluid in the process fluid compartment from the drive compartment, which is preferably in fluid communication with the ambient.

11 Claims, 5 Drawing Sheets

FLUID HANDLING DEVICE FOR HYDROGEN-CONTAINING PROCESS FLUIDS

FIELD OF THE INVENTION

The present invention relates to fluid handling devices in an electrochemical cell system, and more particularly to a fluid barrier in a hydrogen-containing process fluid handling device in an electrochemical cell.

BACKGROUND OF THE INVENTION

Electrochemical fuel cells can be used in a vast array of applications as a power source, including as an alternate power source to the internal combustion engine for vehicular applications. An electrochemical fuel cell contains a membrane sandwiched between electrodes. One preferred fuel cell is known as a proton exchange membrane (PEM), where hydrogen ($H_2$) is used as a fuel source or reducing agent at an anode electrode and oxygen ($O_2$) is provided as the oxidizing agent at a cathode electrode, either in pure gaseous form or combined with nitrogen and other inert diluents present in air. During operation of the fuel cell, electricity is garnered by electrically conductive elements proximate to the electrodes via the electrical potential generated during the reduction-oxidation reaction occurring within the fuel cell.

Fluid handling devices within the fuel cell circulate the process fluids (e.g. reactant gases, coolant, effluent streams) throughout the system. Fluid handling devices that deliver hydrogen-containing gases to and from the anode pose particular design challenges due to the reactivity of hydrogen and hydrogen-containing gases. The fluid handling device should sufficiently isolate the hydrogen-containing process fluids, so that the hydrogen-containing gases are not released into the surrounding environment. Fluid handling devices, such as pumps, blowers, and compressors, typically have rotating shafts that extend through the housing of a motor compartment to a process fluid compartment. The seals surrounding the shaft and separating the motor and process fluid compartments may fully seal process fluids from the environment. Other fluid handling device configurations may isolate the device from the surrounding environment by encasing it in a sealed (e.g. hermetically) protective housing. The present invention relates to improving the fluid barriers of fluid handling devices that handle reactive, corrosive, and/or combustible process fluids, which must be isolated, such as the anode process fluids handled in a fuel cell system.

SUMMARY OF THE INVENTION

One preferred embodiment of the present invention relates to a fluid handling device for a hydrogen-containing process fluid that comprises a process fluid compartment having a first pressure, a drive compartment having a second pressure and having a drive unit for moving the process fluid through the process fluid compartment, and an interconnection compartment disposed between the process fluid compartment and the drive compartment, through which the drive unit extends. A barrier gas storage device in fluid communication with the interconnection compartment has a barrier gas. The interconnection compartment is maintained at a third pressure that is greater than respectively, the first pressure and the second pressure.

An alternate preferred embodiment of the present invention includes a method of isolating hydrogen-containing process fluid in a fluid handling device. The method comprises monitoring a first pressure in a process fluid compartment, monitoring a second pressure in a drive compartment, and monitoring a third pressure in an interconnection compartment having a barrier gas, wherein all of the compartments are in fluid communication with one another via gas migration across seals. The third pressure is maintained at a value greater than the first pressure and the second pressure respectively, whereby the process fluid in the process fluid compartment is prevented from migrating into the drive compartment as the process fluid moves through the process fluid compartment of the fluid handling device.

Another alternate preferred embodiment of the present invention is a method of separating fluids in an anode recirculation fluid handling device in a fuel cell. The method comprises dehumidifying a barrier gas, pressurizing the barrier gas, and supplying the dehumidified and pressurized barrier gas to an interconnection compartment disposed between a process fluid compartment containing hydrogen-containing process fluids and a drive compartment in fluid communication with ambient, wherein the interconnection compartment contains the barrier gas and has a pressure greater than the pressure of the process fluid compartment and the pressure of the drive compartment.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
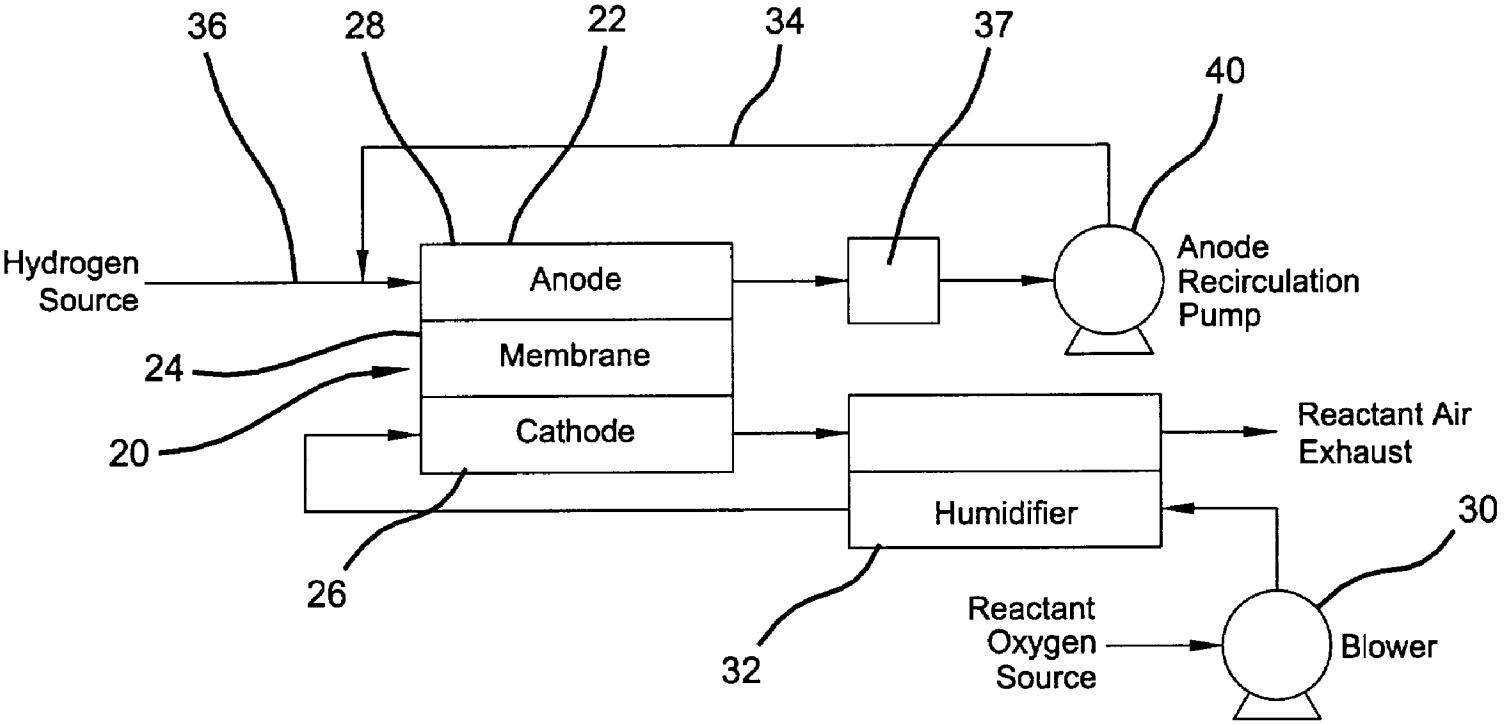
FIG. 1 is a schematic representation of an exemplary fuel cell system having an anode recirculation.

The present invention contemplates a fluid barrier for a fluid handling device in a fuel cell system to separate the process fluids in a stage compartment from a drive compartment and the ambient. The fluid barrier is provided by an additional compartment separating the process fluid and drive compartments. The additional compartment is preferably filled with a barrier fluid (e.g. gas) that has a higher pressure than the neighboring process fluid and drive compartments to prevent fluid flow between the process fluid and drive compartments. The present invention may be employed in fluid handling devices that circulate both liquid and gas phase process fluids. First, to better understand the present invention, a brief description of an exemplary electrochemical fuel cell system, wherein the present invention is useful, is helpful for understanding various aspects of the present invention. As shown in FIG. 1, an individual fuel cell 20 is shown in a stack 22. The stack 22 may optionally comprise a plurality of connected fuel cells, as is well known in the art, however, for simplicity is shown here with only a single fuel cell. The fuel cell 20 comprises a polymer electrolyte membrane 24 that is sandwiched between two electrodes: a cathode 26 and an anode 28. Reactant gases are introduced at both the anode 28 and the cathode 26, in a preferred embodiment, the reactant gas introduced at the anode 28 is hydrogen-containing (a reductant), and the reactant gas introduced at the cathode is oxygen-containing (an oxidant). Fluid handling devices 30, such as pumps or blowers, circulate reactant gases into the stack 22. The cathode and anode electrodes 26, 28 typically contain catalysts to facilitate the electrochemical reaction between the oxygen and hydrogen. A preferred polymer electrolyte membrane 24 is a proton exchange membrane, which permits transport of protons from the anode 28 to the cathode 26, thereby generating an electrochemical potential. Polymer electrolyte membranes 24 require humidification, which is generally provided by a humidifier 32 that supplies moisture to reactant oxygen-containing gas entering the stack 22.

Electrochemical reactions within the fuel cell 20 generate product water which is formed on the cathode 26 side. At the anode 28, hydrogen gas is consumed in proportion to the reactions occurring within the fuel cell 20. During typical operations, there are few or no reaction byproducts generated at the anode 28. Many different configurations for fluid handling at the anode 28 are possible, and fresh hydrogen-containing gas delivered to the anode 28 may be "dead-ended" into the stack 22, where it is assumed that all hydrogen is consumed within the reactions in the fuel cell 20 and anode effluent is not subsequently recycled back into the anode inlet 36. Such a configuration is generally known as "discontinuous" anode gas circulation. Other discontinuous operating configurations may utilize the anode effluent stream by delivering it to different parts of the system or other processes, but the anode effluent is not returned to the anode inlet 36. Re-routing it to other processes may entail directing the anode effluent into a hydrogen reforming plant (not shown) or other areas where residual hydrogen contained in the effluent stream will be consumed. An alternate operating concept, as depicted in FIG. 1, includes a continuous operating loop 34, where the anode effluent stream is recirculated or recycled back into the anode inlet 36 by an anode recirculation pump 40. The recycled anode inlet stream optionally passes through a recirculation loop filter 37 to remove any impurities. Anode gases typically gain moisture while circulating through the fuel cell 20 and are humidified upon exiting the stack 22. Continuous anode recirculation systems are advantageous to various aspects of fuel cell performance, including for moisture conservation. Anode recirculation systems are frequently incorporated into fuel cell system designs.

However, additional handling of hydrogen-containing process gases or fluids, such as anode effluent, can pose operational and quality issues due to the high reactivity of hydrogen. Ignition or other reactive sources may react with the hydrogen in various components in a system, which is problematic. The humidified hydrogen-containing gas leakage into the drive compartment causes corrosion or chemical attack (e.g. passivation) of the various motor components of the motor. Exposing the magnetic materials in the motor of the fluid handling device to hydrogen-containing humidified anode gases appears to detrimentally impact inductive performance and significantly shorten the lifespan of the pump motor. Introduction of additional fluid handling devices (e.g. pumps or blowers) that interface with hydrogen-containing process gases, especially those containing both high humidity and hydrogen, such as the anode recirculation pump 40 in the present context, must be carefully designed to isolate the process fluids. The present invention incorporates conventional mechanical seals, and further provides an additional protective barrier to ensure isolation of the process fluids.

Figure 2:
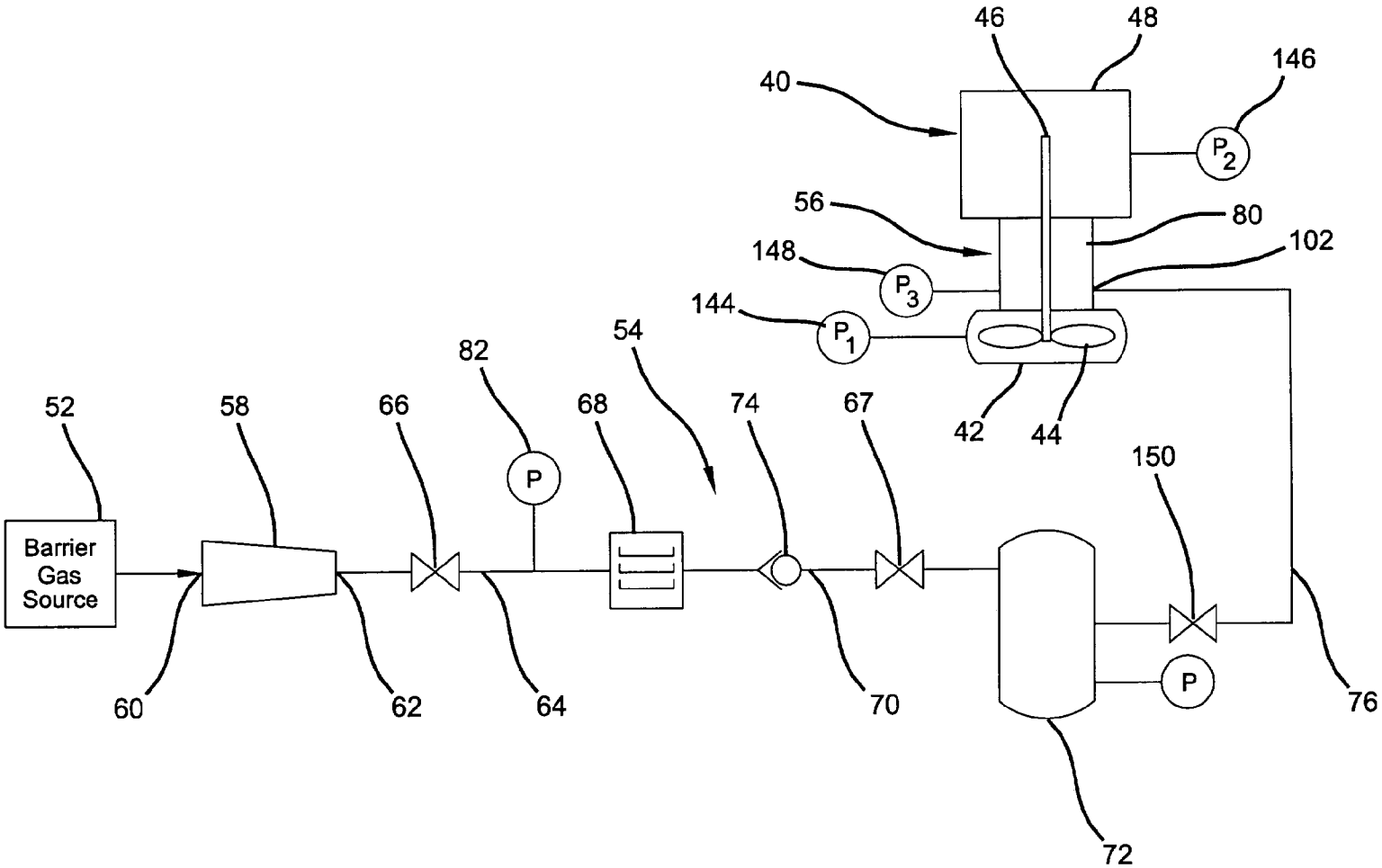
FIG. 2 is a schematic representation showing a fluid barrier sealing system for a fluid handling device according to the present invention.

One preferred configuration of a fluid barrier sealing system in a fluid handling device according to the present invention is shown in FIG. 2. An exemplary fluid handling device, such as the anode recirculation pump 40, has a process fluid or stage compartment 42 that contains and transports the process fluids. A propulsion device (e.g. an impeller 44) provides propulsion for the process fluid as it exits the stage compartment 42, and is connected to a drive unit comprising a rotatable shaft 46 that extends to a motor or drive compartment 48. A barrier fluid, which in certain preferred embodiments is a gas, is drawn from a source 52, and is directed along a barrier gas feed path 54 which supplies a fluid barrier 56 within the anode recirculation pump 40. The barrier gas source 52 may be a storage tank or cylinder, or in the case of air, the ambient. The barrier gas is directed to an inlet 60 of a compressor 58, where it is pressurized. The pressurized barrier gas exits the compressor 58 at an outlet 62 and enters a first passage 64. A valve 66 is located in the first passage 64 to provide isolation and/or regulation of barrier gas flow from the compressor 58.

The barrier gas is directed to a dehumidifier 68 and then through a second passage 70 to a pressurized storage vessel 72. A check valve 74 located within the second passage 70 is biased to allow flow in the direction of the pressurized storage vessel 72 and to prevent backflow in the direction of the humidifier 68. As recognized by one of skill in the art, the order of the compressor 58 and the dehumidifier 68 along the barrier feed path 54 may differ from the one shown in FIG. 2, and may entail first dehumidifying the barrier gas when it is drawn from the source 52 and then pressurizing the barrier gas in the compressor 58, to result in substantially similar conditioning of the barrier gas. Further, compressors may already be incorporated into a system for other processes, and such compressors may have additional capacity. In such a case, the compressor 58 may be shared between the present invention and the other processes within the system. The pressurized storage vessel 72 is connected to a third passage 76 which leads to the fluid barrier 56 in an interconnection chamber or compartment 80 disposed between the stage 42 and drive compartments 48. Pressure gauges 82 are located along the feed path 54. The various pressure measurements from the pressure gauges 82 are used to monitor and control operations of equipment and valves along the barrier gas feed path 54. The precise locations of the gauges 82 may vary from those shown, depending on various system design configurations, as recognized by one of skill in the art.

Figure 3:
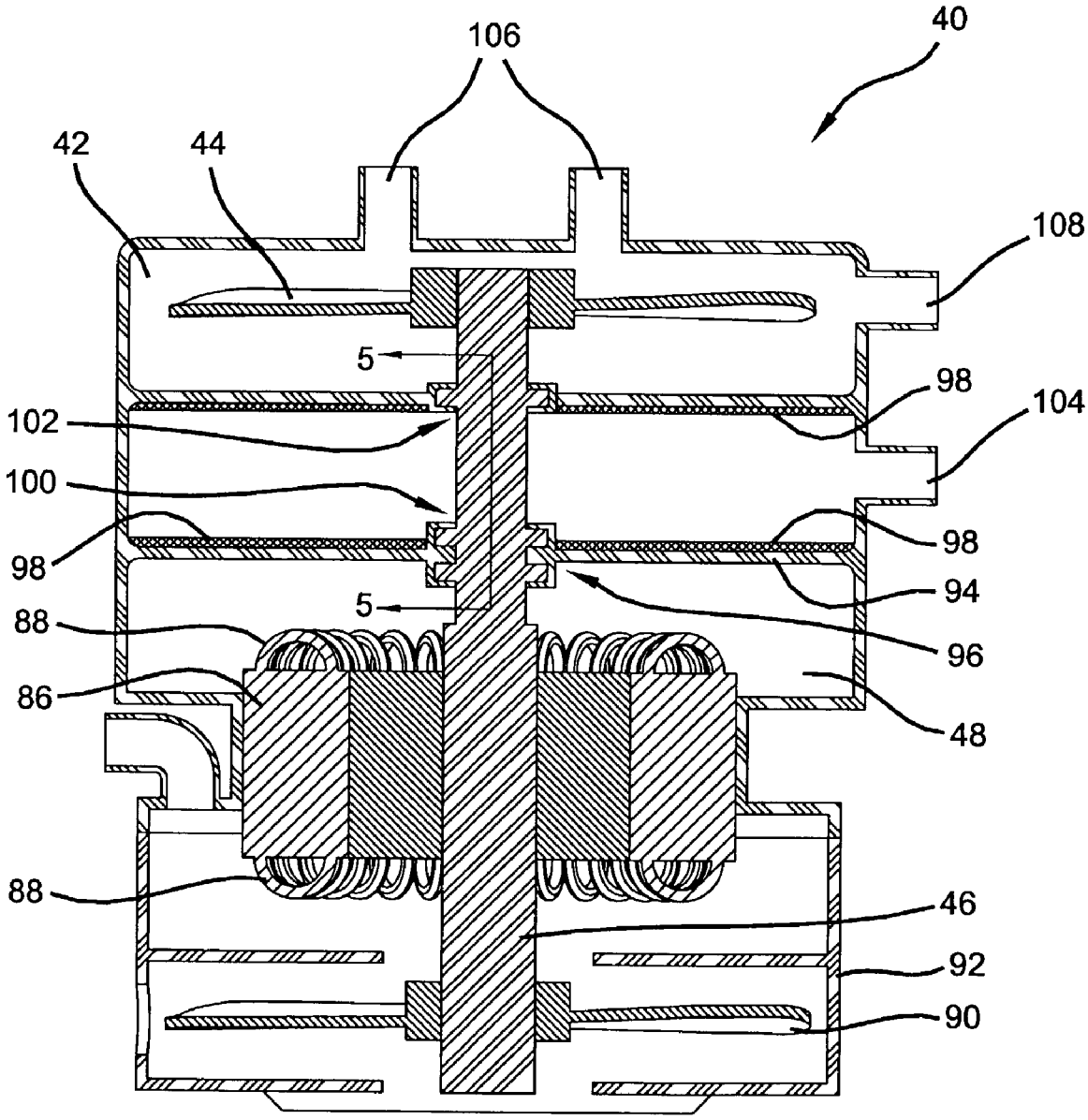
FIG. 3 is a cross sectional view of a fluid handling device having a fluid barrier in accordance with principles of the present invention.

As shown in FIG. 3 the drive compartment 48 of the anode recirculation pump 40 houses the drive unit, which includes the motor 86 that has induction coils 88 that surround the shaft 46 to induce rotation. The shaft 46 of the drive unit ultimately translates motion to the impeller 44 to propel fluids in the stage compartment 42. The shaft 46 extends axially from the drive compartment 48 into and through the interconnection compartment 80 to the stage compartment 42. Generally, a second cooling fan 90 is provided in the drive compartment 48, which draws in ambient air for cooling the motor 86 and its several components. The drive compartment 48 is in fluid communication with the external environment. A housing 92 encases the motor 86 and cooling fan 90 components. The drive compartment 48 is adjacent to the interconnection compartment 80 on a first side 100. The drive compartment 48 housing wall 94 terminates in a seal 96 circumscribing the shaft 46. The seal 96 provides a mechanical fluid barrier between the interconnection compartment 80 and the drive compartment 48.

The stage compartment 42 is adjacent to the interconnection compartment 80 on a second side 102 opposite to the first side 100. Process fluid is introduced to the stage compartment 42 at an inlet 106; and exits at an outlet 108. Such process fluid, in the case of an anode recirculation pump 40, is typically a humidified hydrogen-containing gas, but the present invention may apply to any combustible, poisonous, reactive, or corrosive fluids that must be contained solely in the process fluid stage compartment 42 of a fluid handling device. The present invention is also applicable as a fluid barrier in other fluid handling devices having separated propulsion and drive compartments, such as compressors, blowers, and the like.

According to one preferred embodiment of the present invention, the interconnection compartment 80 is an area disposed between and adjacent to both the drive 48 and process fluid stage 42 compartments along the opposite first and second sides 100,102. The interconnection compartment 80 has a housing 98, which may share common walls with the drive and/or stage compartments 48,42, in the regions proximate to the drive and stage compartments 48, 42. In alternate preferred embodiments, the interconnection compartment 80 may optionally form an entirely separate housing with independent walls and seals. The third passage 96 (FIG. 2) is connected to an inlet 104 of the interconnection compartment 80, where barrier fluid is filled and supplied thereto. One aspect of the present invention includes regulating and maintaining the pressure of the interconnection compartment 80 above the pressure of the two neighboring compartments 42,48, as will be described in more detail below. According to preferred embodiments of the present invention, the barrier fluid of the interconnection compartment 80 provides additional means of isolating the process fluids circulating through the stage compartment 42 from the drive compartment 48 and external environment (in addition to the mechanical seals 96 disposed at the junction or boundary between the housing of each compartment and the shaft 46). In preferred embodiments of the present invention, the barrier fluid is a barrier gas, which has sufficient pressure to provide fluid isolation, generally where the process fluid is gaseous. In alternate preferred embodiments, the barrier fluid may be a liquid, which can be pressurized to isolate process fluids which may be liquids.

Figure 4:
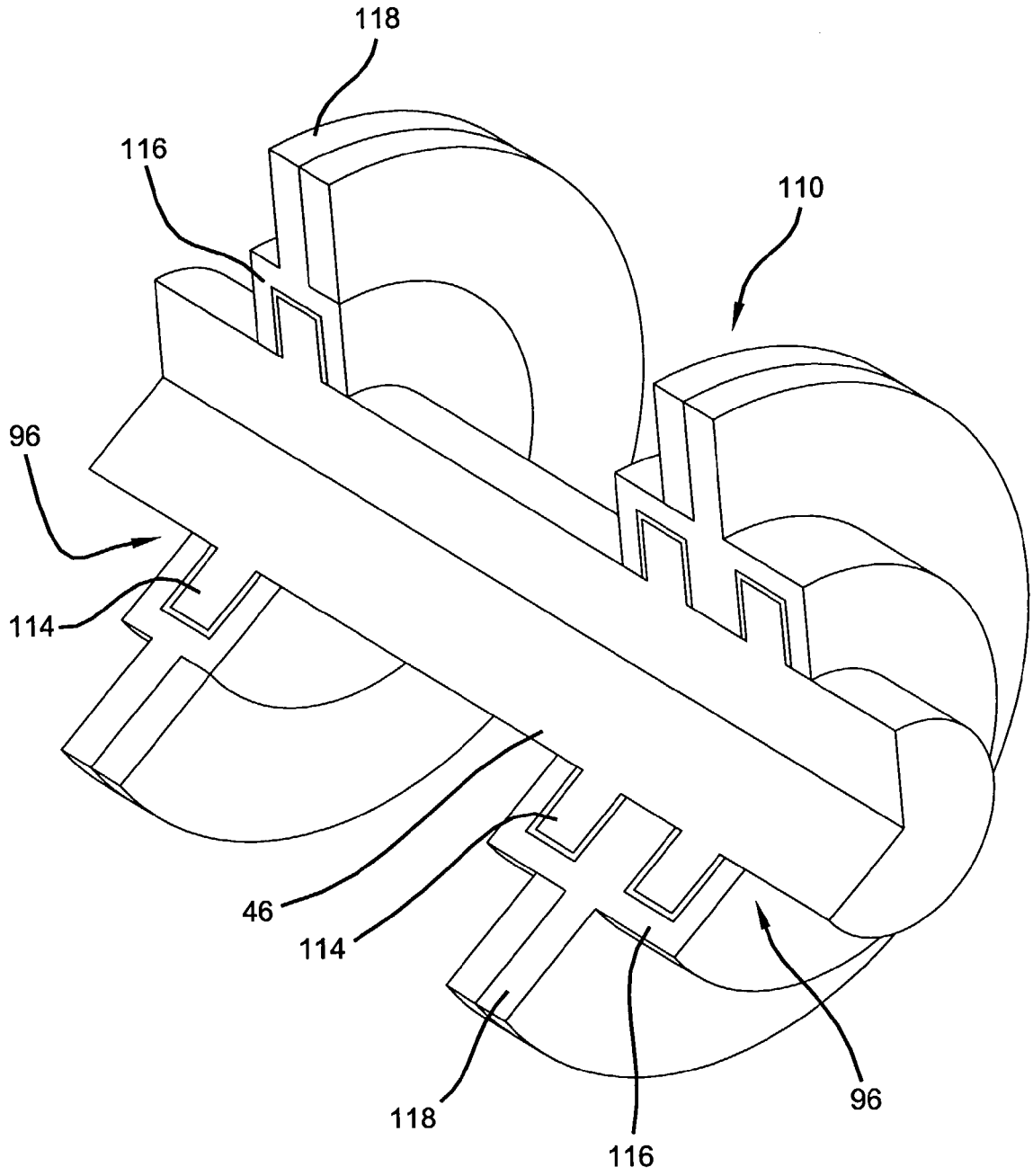
FIG. 4 is a cut away perspective view of a shaft and seals of the fluid barrier of FIG. 3.

Two exemplary labyrinth type seals 96 are depicted generally in FIG. 4, with lands 114, or rotors, fixedly attached to and extending around the entire circumference of the shaft 46. The lands 114 rotate with the shaft 46 during operation. Corresponding stators, or grooves, 116 are formed along the circumference of the surface of housing walls 118 that circumscribe the shaft 46. The lands 114 protrude into the corresponding grooves 116 such that a small gap is formed between the surfaces of the lands 114 and grooves 116, respectively. These small gaps permit rotational movement of the shaft 46.

Figure 5:
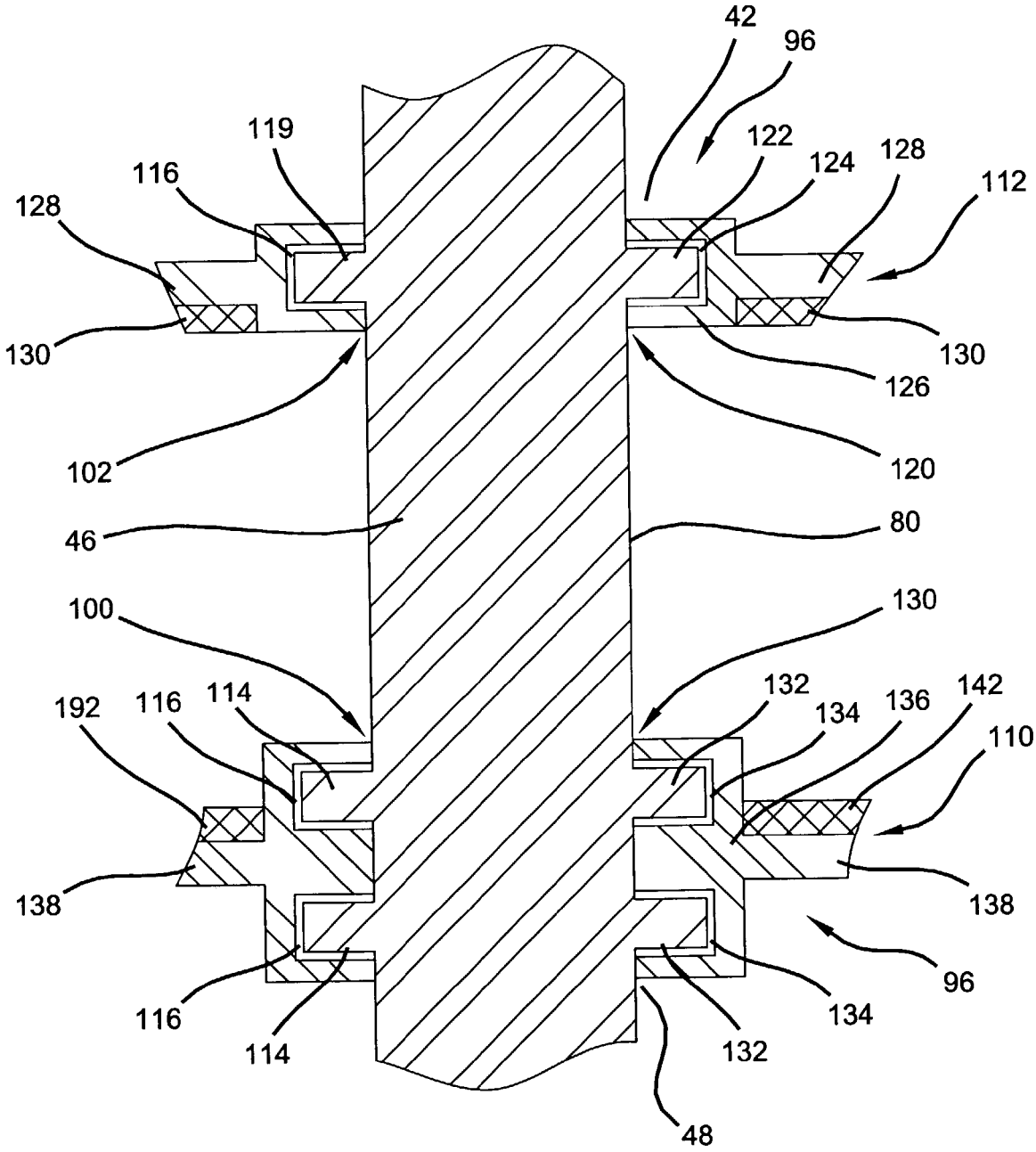
FIG. 5 is a partial cross sectional view taken along line 5—5 of the fluid barrier of FIG. 3.

FIG. 5 shows a detailed cross sectional view of the annular seals 96 along the rotary shaft 46 of both a first boundary 110 between the drive and interconnection compartments, 48,80 and a second boundary 112 between interconnection and stage compartments 42,80. The grooves 116 are formed along the circumference of the surface of the housing walls 118 of both the first intercompartment boundary 110 and second intercompartment boundary 112. A first seal 120 is formed by a first metal land 122 circumscribing the rotary shaft 46 which protrudes into a corresponding first groove 124 formed in a terminal end 126 of a housing wall 128 of the stage compartment 42. A first interconnection compartment wall 130, next to the housing wall 128 of the stage compartment 42, terminates and merges with the stage compartment housing wall 128 at the terminal end 126 to form the first seal 120 configuration.

A second seal 130 is formed by a plurality of second metal lands 132 extending around the circumference of the shaft 46. The corresponding second grooves 134 are formed in a terminal end 136 of a housing wall 138 of the drive compartment 48, in the same manner as first seal grooves 124. A second housing wall 142 of the interconnection compartment 80 extends along the length of the drive compartment 48 housing wall 138 until they merge at the terminal end 136 of the drive compartment housing wall 138 to form the second labyrinth seal 130 configuration.

Any conventional seals may be used in the present invention, as recognized by one of skill in the art, and the exemplary seal construction shown is non-limiting. As recognized by one of skill in the art, most seals experience some level of fluid migration across the seal. Further, seals with relatively low fluid migration are typically far more expensive to manufacture and costly to maintain. Thus, according to the present invention, a small amount of fluid migration across the seals is incorporated into preferred embodiments of the present invention, which allows for less expensive fabrication and maintenance of the seals. The less expensive sealing configurations which are compatible with the present invention, include for example, non-contact labyrinth seals or contact face seals, and may also include grease barrier or piston-ring sealing.

The configuration of double lands 132 and grooves 134 in the second seal 130, provides additional protection from process fluids potentially entering the drive compartment 48, which further reduces the quantity of barrier gas potentially flowing into the drive compartment 48, and correspondingly into the atmosphere. The exemplary first seal 120 configuration shown has a single land 114 and a single groove 116, which permits greater quantities of barrier gas to migrate to the stage compartment 42. Such configurations are merely exemplary and are selected based on the relative physical isolation or protection needed for the respective compartments, accounting for the properties of the process and barrier gases, and the selection of the mechanical seals in combination with various aspects of the fluid barrier and according to the present invention.

A first pressure within the stage compartment 42 is designated as $P_1$. A second pressure within the drive compartment 48 is designated as $P_2$, and a third pressure within the interconnection compartment 80 is designated as $P_3$. One preferred aspect of the present invention involves maintaining the interconnection compartment chamber pressure, $P_3$, at a higher level than the pressure of either of the adjacent compartments (i.e. $P_1$, $P_2$), thus providing a fluid barrier 56 that prevents process fluid from migrating from the stage compartment 42 into the drive compartment 48, or external environment. Preferably, $P_3>P_1$ and $P_3>P_2$, where the pressure of the barrier gas in the interconnection compartment 80 exceeds that of the neighboring stage and drive compartments 42,48.

Slight quantities of barrier gas migrate across the first and second seals 120,130 flowing from the direction of higher pressure to the region of lower pressure, which translates to barrier gas flow into both the stage compartment 42 and the drive compartment 48 originating from the interconnection compartment 80. The amount of leakage across the seals 96 is dependent on the differential pressure between $P_3$ and $P_1$ or $P_2$, respectively. The pressure of the anode recirculation loop in a fuel cell is dependent upon the fuel cell system pressure, which is in turn generally a function of the power level output of the fuel cell. Other variables within the fuel cell further limit the operating system pressures, including membrane pressure tolerance levels. The higher interconnection compartment 80 pressure $P_1$, enables the fluid sealing barrier 56 of the present invention, by matching or exceeding the overall pressure of the fuel cell, as it operates. Generally, the fluid barrier 56 pressure is designed to be slightly higher than the maximum pressure achieved in the fuel cell system.

Barrier gas that leaks into the stage compartment 42 combines with the process fluids, and enters the fuel cell 20 downstream. Selecting the composition of the barrier gas involves evaluating the impact that the barrier gas may have on fuel cell 20 operations. Although the concentration of the quantity of barrier gas flowing into the fuel cell 20 is preferably small or negligible, compatibility with the internal components of the fuel cell 20 is important to avoid poisoning of the electrode catalysts, membrane 24, or other components. Likewise, the barrier gas also enters the drive compartment 48 where it interfaces with the motor 86 components. Although the quantity of barrier gas entering the drive compartment 48 is preferably negligible or small, appropriate compatibility with the drive compartment 48 components and the external environment is also important. Thus, selection of a suitable barrier gas according to the present invention balances the physical properties of the gas and their impact on the system with relative cost. It is desirable to select a barrier gas that is non-reactive, non-corrosive, non-combustible, and generally safe for handling and dispersing into the surrounding atmosphere, in addition to compatibility with the fuel cell. Generally, inert gases are preferred barrier gases according to the present invention, however, air is also a suitable barrier gas due to its widespread abundance and relatively low reactivity with the fuel cell, motor components, and the environment. Examples of preferred barrier gases in accordance with the present invention include, for example, air (approximately 79% $N_2$, 21% $O_2$, and other trace diluents), nitrogen, helium, and mixtures thereof.

The fluid barrier 56 of the present invention operates by maintaining a positive differential pressure between the barrier gas pressure ($P_3$) in the interconnection compartment 80 and the pressure of the stage compartment 42 pressure ($P_1$, which correlates to the pressure of the process fluids in the anode recirculation loop. The pressure for the anode recirculation loop varies from between about 1 to 2.8 bar absolute, for example. The drive compartment 48 pressure ($P_2$) is preferably equilibrated with ambient pressure approximately equal to the surrounding atmospheric pressure of 1 bar absolute. However, it is contemplated that such values are dependent upon fuel cell system design, and may vary greatly. In most fuel cell systems, the fuel cell operating system pressure exceeds ambient pressure, and thus, a primary consideration is the differential pressure between the interconnection chamber pressure, $P_3$, and the stage compartment pressure $P_1$, rather than with the drive compartment pressure $P_2$.

According to the present invention, a positive differential pressure is maintained between the interconnection 80 and stage 42 compartments, such that $P_3-P_1=\Delta P_1$, where $\Delta P_1$ is preferably greater than or equal to 0. The barrier gas buffers and blocks process fluid from entering into the interconnection compartment 80 and further forces barrier gas to flow into the stage compartment 42, when there is fluid communication via fluid migration across the seal. In such a configuration, the differential pressure between the interconnection compartment 80 and the drive compartment 48 is given by $P_3-P_2=\Delta P_2$ and $\Delta P_2$ will likewise be maintained at a value greater than or equal to zero that favors barrier gas flowing towards the drive compartment 48, because $P_2$ is a lower value.

Fuel cell operations fluctuate greatly during various operating conditions, such as start-up or variations in power demand. Hence, the pressure of the fuel cell operating system is likewise dynamic and may undergo transient operational periods. System design according to the present invention, optimizes the differential pressure values of the fluid barrier 56 (i.e., $\Delta P_1$ and $\Delta P_2$) to be sufficient when the process fluids are at maximum pressures, accounting for potential pressure spikes in the anode (and hence fuel cell) operations, while not being so great that large quantities of barrier gas are driven into the stage or drive compartments 42,48 possibly unfavorably impacting fuel cell or motor operations.

As previously discussed, seal leakage (i.e. fluid migration across the seal) is a function of differential pressures and increases in conjunction with increased differential pressure. The quantity of barrier gas leakage into the stage compartment 42 is often expressed as a power loss, meaning that the reduced quantity of hydrogen in the process fluid (displaced by barrier gas) translates to a corresponding power loss in the fuel cell. Such a rate of hydrogen loss is preferably less than or equal to about 100 W. In certain exemplary fuel cell systems, a differential pressure for both $\Delta P_1$ and $\Delta P_2$ is at least 0.1 bar to maintain the integrity of the fluid barrier. Thus, an average differential pressure value between the interconnection 80 and stage 42 compartments, $\Delta P_1$, is preferably from about 0.1 to 0.5 bar, for example. An average value indicates the differential pressure value maintained over a duration of time, by averaging the instantaneous differential pressure values. At such levels, the differential pressure is relatively small, yet sufficiently high for a fluid barrier. As appreciated by one of skill in the art, many variables in a system may impact the required barrier gas pressure, and thus, both $P_3$ and the differential pressures $\Delta P_1$ and $\Delta P_2$ may vary greatly depending on system design. The quantity of fluid migration occurring across the seals is preferably small, such as in preferred embodiments where the hydrogen power loss is less than 100 W, which only minimally impacts fuel cell 20 operations.

The pressure of the interconnection compartment 80 is maintained by the supply of pressurized barrier gas stored in the storage vessel 72. In one preferred embodiment of the present invention, the compressed and dried air that is used as reactant for the cathode inlet is diverted from the cathode compressor/blower 30 for use as the barrier gas and introduced into the storage vessel 72. Subsequently, the barrier gas is introduced into the inlet 104 of the interconnection compartment 80. The cathode reactant gases are maintained at a higher pressure than the anode side by the compressor 30. Thus, the compressor 58 operation is coupled to that of the cathode compressor 30 to provide both a cathode reactant and a relatively high pressure barrier gas. Optionally, the dehumidifier 68 may be used on the compressed gas provided by the compressor 30, or may coupled to another dehumidifier (not shown) in the system. Thus, the present embodiment presents a simplified system, because duplicate gas conditioning systems are not required, and further there is no need for independent pressure instrumentation within the compartments, as the cathode pressure is maintained above the anode pressure for fuel cell operations.

In an alternate preferred embodiment, conventional pressure gauges (as shown generally in FIG. 2 at 82) are situated within each of the compartments, preferably in close proximity to the seals 96. A first pressure gauge 144 is placed within the stage compartment 42 to measure $P_1$. A second pressure gauge 146 within the drive compartment 48 measures $P_2$, and a third gauge 148 placed within the interconnection compartment 80 measures $P_3$. Other pressure gauges 82 within the system, include those placed along the barrier gas feed path 54 (FIG. 2). As recognized by one of skill in the art, additional pressure gauges may be incorporated into the system to provide additional pressure levels and system redundancy, if necessary. The pressure measurement outputs are preferably input into a controller (not shown), e.g. a control processing unit, that preferably also controls the equipment and valve operations along the feed path 54, including actuating valves 66 and 67 and operating the compressor 58 and humidifier 68, for example. In view of the extent of the disclosure, a detailed discussion of the construction and operation of the controller need not be provided herein as such controllers are well within the capabilities of one skilled in the art.

$P_1$, $P_2$, and $P_3$ are input values into the controller, and these input values may be compared to a setpoint to calculate the differential pressure values $\Delta P_1$ and $\Delta P_2$. Preferably, the setpoint or predetermined control value is calculated as a function of the pressure measurement readings, such that the system can dynamically account for operating pressure fluctuations in the fuel cell. Such a setpoint may be determined by merely using the direct pressure measurements, or by adding an incremental value to the pressure measurements to calculate differential pressure values. For example, if preferred differential pressures for $\Delta P_1$ and $\Delta P_2$ are 0.3 bar, the setpoints may be calculated as $P_1$+0.3 bar for setpoint 1, and $P_2$+0.3 bar for setpoint 2. Thus, the controller subtracts the setpoint 1 from the input value for $P_3$ and likewise the setpoint 2 from the input value for $P_3$, to calculate the actual values for $\Delta P_1$ and $\Delta P_2$. If the calculated actual value of either $\Delta P_1$ and $\Delta P_2$ approaches zero or becomes a negative value, $P_3$ will be increased to the reestablish a positive value. In practice, a margin of error (i.e. 5 to 15% above the minimum pressure value for $P_3$) may be incorporated into the setpoint values to correct for control system lag times, under compensation, or system inaccuracies.

In preferred alternate embodiments of the present invention, the controller maintains positive $\Delta P_1$ and $\Delta P_2$ by actuating a release valve 150 for the pressurized storage vessel 72 to open when the $\Delta P_1$ or $\Delta P_2$ falls too low. When $P_3 \leqq P_1$ or $P_3 \leqq P_2$ (which may be ascertained directly or based on controller setpoint calculations, such as the exemplary setpoints discussed above), the pressurized storage vessel valve 150 is opened, supplying pressurized barrier gas to increase $P_3$ to match the setpoint or predetermined control value (i.e. to reestablish the predetermined positive $\Delta P_1$ or $\Delta P_2$ value). In certain preferred embodiments of the present invention, the release valve 150 is actuated prior to $P_3$ equaling or falling below the values of $P_1$ or $P_2$ to avoid reverse flow into the interconnection compartment 80 and possibly the drive compartment 48.

The pressurized storage vessel 72 releases barrier gas through the third supply passage 76 to the interconnection compartment 80 to respond as necessary to the pressure fluctuations occurring in the fuel cell system, and measured by the pressure gauges 82. In preferred embodiments of the present invention, the storage volume for pressurized gas stored in the pressurized storage vessel 72 is in excess of the actual volume necessary to directly and continuously supply the interconnection compartment 80 to maintain a $P_3$ that favors positive $\Delta P_1$ and $\Delta P_2$ values. In essence, the pressurized storage vessel 72 has reserve capacity, both as a contingency for any system fluctuations or failures, as well as to allow for discontinuous intermittent compressor 58 operation. Such a volume is specific to an individual system, and is dependent upon barrier gas flow rate and compressor 58 performance.

The compressor 58 pressurizes the barrier gas to a designated predetermined pressure, generally selected to be high enough to maintain the interconnection compartment 80 to be at least 0.1 to 0.5 bar above the neighboring compartments 42,48, as previously discussed. Such a pressure may be 3 bar absolute, in an exemplary fuel cell system that operates at a maximum of 2.8 bar absolute where the differential pressure would be 0.2 bar. The compressor 58 may pressurize barrier gas up to about 10 bar absolute or higher, if it is necessary to match a fuel cell system which operates at high pressures. The required maximum pressure of compressed gas is determined by at least equaling (and preferably exceeding) the maximum pressure that a fuel cell system experiences, accounting for start-up and variable power demand situations. The compressor 58 may be operated intermittently (i.e. discontinuously) to supply the pressurized gas from the compressor 58 to the pressurized storage vessel 72. Further, as previously discussed, the compressor 58 may be shared with the cathode reactant gas compressor 30. Alternatively, the storage vessel 72 may be connected to the compressor 58, as well as to the cathode compressor 30, to provide additional pressurization of the barrier gas, or may serve as a contingent pressurized barrier gas source. In alternate preferred embodiments of the present invention, the barrier gas may be pre-pressurized and stored in tanks, which may constitute the pressurized storage vessel 72. In such an embodiment, a compressor 58 is not necessary, as the gas is already pressurized to the appropriate level. Further, such a pressurized storage vessel 72 could be interchanged or recharged with new pressurized barrier gas, as the supply decreases.

Another advantage of a preferred embodiment of the present invention is that the barrier gas is dehumidified. With renewed reference to FIG. 2, the barrier gas may be processed by a dehumidifier 68, prior to entering the pressurized storage vessel 72. Any humidified barrier gas that migrates from the interconnection compartment 80 to the drive compartment 48 may contribute to corrosion of the motor 86 components. Thus, in certain preferred embodiments of the present invention, a dehumidifier 68 is used to remove moisture from the barrier gas, prior to entering the pressurized storage vessel 72 and the interconnection compartment 80. If the source of the barrier gas is a gas storage canister or tank, the gas may be sufficiently pre-dehumidified that it does not require a dehumidification step. Thus, the present invention provides a barrier gas in a fluid barrier 56 that does not react with or attack motor 86 components, while further isolating harmful process fluids from release into the drive compartment 48 and the atmosphere.

The present approach alleviates difficulties attendant to efforts to construct better mechanical seals, which are complex designs with many parts that are costly. Further, more complex mechanical seals are expensive to maintain and may have relatively low useful life, and further may not ensure complete physical isolation of the process fluids. The present invention eliminates a need to use such complex mechanical seals that provide complete physical isolation.

The present invention may also be contrasted to other methods of isolating process fluids from the other compartments and the surrounding environment by enclosure of the entire pump, including the drive and the process fluid compartments. Such enclosures are generally hermetically sealed to ensure isolation of the process fluids from the external environment. However, such sealing is also expensive and typically exposes the drive compartment to humidified hydrogen-containing gas, in the case of an anode effluent stream, which may cause corrosion or inactivation of the various components of the motor components. Thus, the present invention provides fluid handling devices and methods of isolating process fluids that prevent both migration of process fluids into the surrounding environment, while further protecting the drive compartment from any degradation or attack by the process fluids. The present invention provides a highly effective isolation of process fluids, and can be incorporated into fuel cell systems with relative ease and low cost.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fluid handling device for a hydrogen-containing process fluid comprising:

a process fluid compartment having a first pressure;

a drive compartment having a second pressure and having a drive unit for moving the process fluid through said process fluid compartment, where the drive compartment is in fluid communication with an external environment;

an interconnection compartment disposed between said process fluid compartment and said drive compartment, through which said drive unit extends; and a barrier gas storage device in fluid communication with said interconnection compartment that supplies barrier gas to said interconnection compartment via a barrier gas inlet, wherein said interconnection compartment contains said barrier gas that is maintained at a third pressure that is greater than said first pressure and said second pressure respectively.

2. The fluid handling device according to claim 1, wherein said drive unit comprises:

a rotatable shaft extending from said drive compartment through said interconnection compartment and into said process fluid compartment;

wherein a first seal surrounds said rotatable shaft at a first boundary between said drive compartment and said interconnection compartment, and a second seal surrounds said rotatable shaft at a second boundary between said interconnection compartment and said process fluid compartment; and wherein a first quantity of barrier gas migrates across said first seal from said interconnection compartment to said process fluid compartment, and wherein a second quantity of barrier gas migrates across said second seal from said interconnection compartment to said drive compartment.

3. The fluid handling device according to claim 2, wherein said first seal and said second seal are labyrinth seals.

4. The fluid handling device according to claim 1, wherein said third pressure is maintained by controlling release of said barrier gas from said barrier gas storage device.

5. The fluid handling device according to claim 1, wherein said third pressure is greater than or equal to a first minimum pressure that is at least 0.1 bar greater than said first pressure.

6. The fluid handling device according to claim 1, wherein said third pressure is greater than or equal to a second minimum pressure that is at least 0.1 bar greater than said second pressure.

7. The fluid handling device according to claim 1, wherein said first quantity of said barrier gas is less than or equal to 100 W of loss of hydrogen in a fuel cell.

8. The fluid handling device according to claim 1, wherein said barrier gas is pressurized by a compressor prior to entering said barrier gas storage device.

9. The fluid handling device according to claim 1, wherein said barrier gas is dehumidified prior to entering said barrier gas storage device.

10. The fluid handling device according to claim 1, wherein said barrier gas is selected from the group consisting of: nitrogen, air, helium, and mixtures thereof.

11. The fluid handling device according to claim 1, wherein said process fluid comprises hydrogen-containing anode effluent.

* * * * *